US011053770B2

(12) United States Patent
Mack et al.

(10) Patent No.: US 11,053,770 B2
(45) Date of Patent: Jul. 6, 2021

(54) COILED TUBING DEPLOYED ESP WITH SEAL STACK THAT IS SLIDABLE RELATIVE TO PACKER BORE

(71) Applicant: Baker Hughes Incorporated, Houston, TX (US)

(72) Inventors: John J. Mack, Catoosa, OK (US); Robert Clay Patterson, Stilwell, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 197 days.

(21) Appl. No.: 15/399,130

(22) Filed: Jan. 5, 2017

(65) Prior Publication Data

US 2017/0254172 A1 Sep. 7, 2017

Related U.S. Application Data

(60) Provisional application No. 62/301,875, filed on Mar. 1, 2016.

(51) Int. Cl.
*E21B 33/12* (2006.01)
*E21B 43/12* (2006.01)

(52) U.S. Cl.
CPC ..... *E21B 33/1208* (2013.01); *E21B 43/128* (2013.01)

(58) Field of Classification Search
None
See application file for complete search history.

(56) References Cited

U.S. PATENT DOCUMENTS

| | | | | | |
|---|---|---|---|---|---|
| 823,760 | A * | 6/1906 | Callanhan | E21B 33/128 | 277/338 |
| 1,147,108 | A * | 7/1915 | McKissick | E21B 23/01 | 166/215 |
| 3,792,732 | A * | 2/1974 | Stewart | E21B 33/10 | 166/127 |
| 4,537,257 | A | 8/1985 | Todd | | |
| 4,657,084 | A | 4/1987 | Evans | | |
| 5,000,265 | A * | 3/1991 | Pleasants | E21B 33/1295 | 166/122 |
| 5,261,492 | A * | 11/1993 | Duell | E21B 23/02 | 166/128 |
| 5,348,092 | A * | 9/1994 | Cornette | E21B 17/22 | 166/114 |

(Continued)

OTHER PUBLICATIONS

Jonathan Bellarby, Well Completion Design, 2009, Elsevier, First Edition. Chapter 1 pp. 1-13 (Year: 2009).*

*Primary Examiner* — Robert E Fuller
*Assistant Examiner* — Theodore N Yao
(74) *Attorney, Agent, or Firm* — Bracewell LLP; Keith Derrington

(57) ABSTRACT

An electrical submersible pump ("ESP") has a seal member that carries a packer. A retainer initially retains the packer in a fixed axial position with the seal member as the ESP is lowered into a well conduit. The retainer is releasable after the packer has been set in the conduit in response to a thermal growth axial force on the seal member, enabling relative axial movement between the seal member and the packer. The seal member has annular seal rings that extend over an axial length on the tubular member that is greater than an axial length of the bore of the packer.

5 Claims, 2 Drawing Sheets

(56) References Cited

U.S. PATENT DOCUMENTS

| | | | | |
|---|---|---|---|---|
| 5,479,991 | A | 1/1996 | Robison et al. | |
| 6,834,727 | B2 | 12/2004 | Wills et al. | |
| 7,055,595 | B2 | 6/2006 | Mack et al. | |
| 7,753,129 | B2 | 7/2010 | Head | |
| 8,528,632 | B2 * | 9/2013 | Mack | E21B 43/128 166/106 |
| 8,636,074 | B2 | 1/2014 | Nutley et al. | |
| 8,684,100 | B2 | 4/2014 | Tingler et al. | |
| 2007/0144746 | A1 * | 6/2007 | Jonas | E21B 17/028 166/380 |
| 2008/0017376 | A1 * | 1/2008 | Badalamenti | C04B 28/02 166/292 |
| 2009/0008088 | A1 * | 1/2009 | Schultz | E21B 36/02 166/249 |
| 2011/0194949 | A1 * | 8/2011 | Parmeter | E21B 43/128 417/53 |
| 2012/0160523 | A1 * | 6/2012 | Burgos | E21B 33/129 166/387 |
| 2016/0177684 | A1 * | 6/2016 | Parks | E21B 43/128 166/369 |
| 2016/0258245 | A1 * | 9/2016 | Eldho | E21B 33/12 |

* cited by examiner

COILED TUBING DEPLOYED ESP WITH SEAL STACK THAT IS SLIDABLE RELATIVE TO PACKER BORE

CROSS REFERENCE TO RELATED APPLICATION

This application claims priority to provisional application Ser. No. 62/301,875, filed Mar. 1, 2016.

FIELD OF THE DISCLOSURE

This disclosure relates in general to electrical submersible well pumps and in particular to a pump assembly with a packer that is run with the pump assembly, the pump assembly having a seal stack that seals in the packer bore and is movable relative to the packer bore in response to thermal growth.

BACKGROUND

Electrical submersible well pump assemblies (ESP) are often used to pump hydrocarbon producing wells. A common type of ESP has a centrifugal pump mounted above an electrical motor. A string of production tubing secures to the upper end of the pump and is used to lower the ESP into the well. Power cable for the motor extends alongside the production tubing to the motor. Supplying power to the motor causes the pump to pump well fluid up the production tubing.

If a failure of the power cable or ESP occurs, normally the well operator must pull the production tubing and the ESP from the well with a workover rig. A workover rig procedure takes time and can be expensive.

ESP's are also installed in a variety of manners using coiled tubing deployed from a reel. In one technique, the power cable is located inside the coiled tubing, and the ESP is deployed within the production tubing. The coiled tubing is hung from the wellhead, and the ESP discharges up the tubing around the coiled tubing. A packer in the production tubing will isolate the intake of the ESP from the discharge. A coiled tubing installation may avoid the need for a workover rig to pull the production tubing, because the pump can be retrieved by winding up the coiled tubing.

One disadvantage of a coiled tubing installation is due to well temperatures that are high enough to cause significant thermal growth of the coiled tubing as compared to the thermal growth of the production tubing. The thermal growth could possibly push the packer down in the production tubing, causing the packer to lose sealing engagement with the production tubing. Alternately, the thermal growth could cause the coiled tubing hanger in the wellhead to move up from its support.

SUMMARY

An assembly for pumping well fluid from a well comprises an ESP having a longitudinal axis, a pump and a motor. The ESP is adapted to be lowered into a conduit of a well. A seal member having at least one annular seal is connected into the ESP concentric with the axis of the ESP. A packer carried by the ESP is configured to set in the conduit at a selected depth. The packer has a body with a bore through which the seal member extends with the seal in sealing engagement with the bore. A retainer initially retains the packer in a fixed axial position with the seal member as the ESP is lowered into the conduit. The retainer is releasable after the packer has been set in response to an axial force on the seal member, enabling relative axial movement between the seal member and the packer.

The seal member comprises a tubular member having a central passage for receiving the flow of well fluid while the pump is operating. The annular seal comprises a plurality of annular seal rings mounted around the tubular member and axially spaced apart from each other. The seal rings extend over an axial length on the tubular member that is greater than an axial length of the bore of the packer. Prior to the retainer being released, at least one of the seal rings will be located above the bore of the packer. After the retainer is released, at least one of the seal rings will be located below the bore of the packer.

The seal member is configured to move downward relative to the packer after the retainer has released. In one embodiment, the retainer comprises a shear member extending between the seal member and the packer. The shear member is configured to shear in response to the axial force reaching a selected minimum.

In the embodiment shown, the seal member comprises an axially extending tubular intake member at a lower end of the ESP and extending downward from the pump. An external flange on a lower end of the intake member is located below and in abutment with a lower end of the packer. The flange has an outer diameter greater than an inner diameter of the bore of the packer to retain the packer on the intake member. In the embodiment shown, an internal flange is located above the external flange within the bore of the packer while the retainer is in a retaining position. The retainer comprises a shear member extending laterally through a packer shear member hole in a side wall of the packer and into an internal flange hole in the internal flange.

In the embodiment shown, the motor is located above the pump. A string of coiled tubing extends upward from the motor for mounting to a wellhead at an upper end of the well. A power cable leading from the motor through the coiled tubing supplies power to the motor. The axial force occurs in response to thermal growth of the coiled tubing relative to the conduit after the packer has been set.

The packer may have a sleeve surrounding the body of the packer. The sleeve may be of an elastomeric material that swells into sealing engagement with the conduit in response to contact with well fluid to set the packer in the conduit.

Figure 1A:
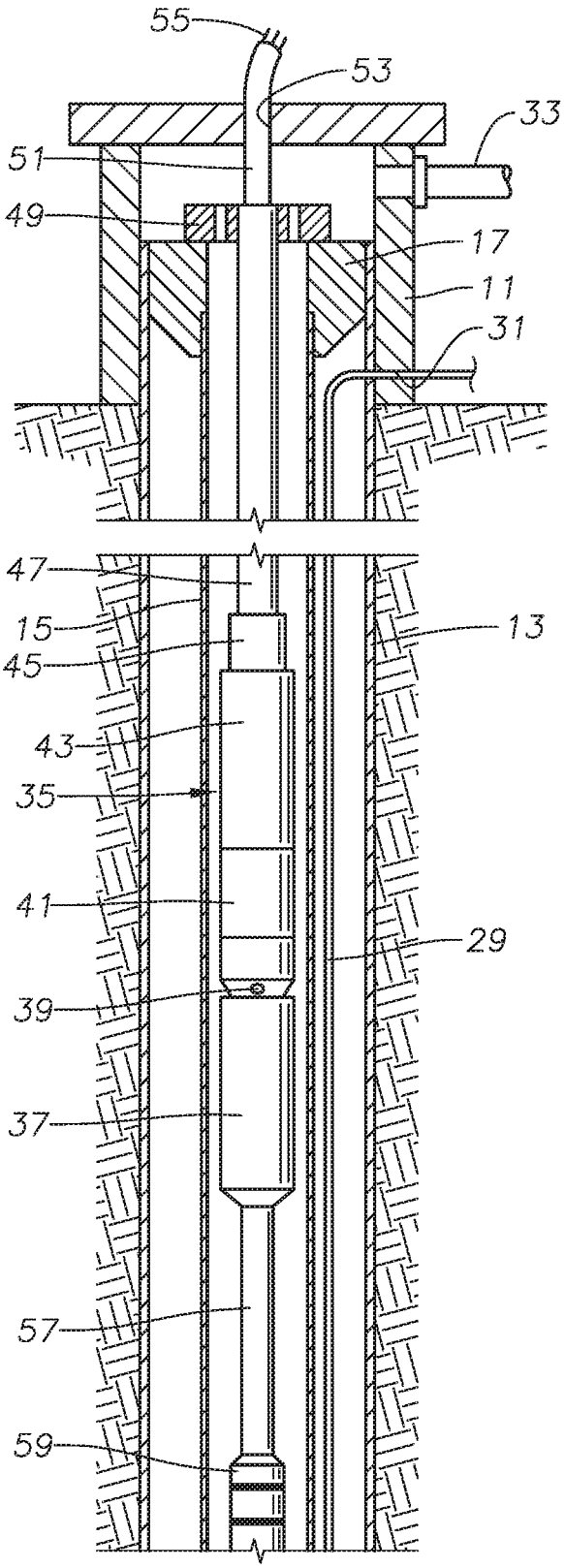
FIGS. 1A and 1B comprise a schematic side view of first and second pump assemblies, the upper or second pump assembly being supported by coiled tubing and having a seal stack and packer in accordance with this disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE DISCLOSURE

The method and system of the present disclosure will now be described more fully hereinafter with reference to the accompanying drawings in which embodiments are shown.

The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1A schematically illustrates a wellhead 11. A string of casing 13 extends down from wellhead 11 and is cemented in a well. A string of production tubing 15 has a tubing hanger 17 on an upper end that is supported in wellhead 11.

Figure 1B:
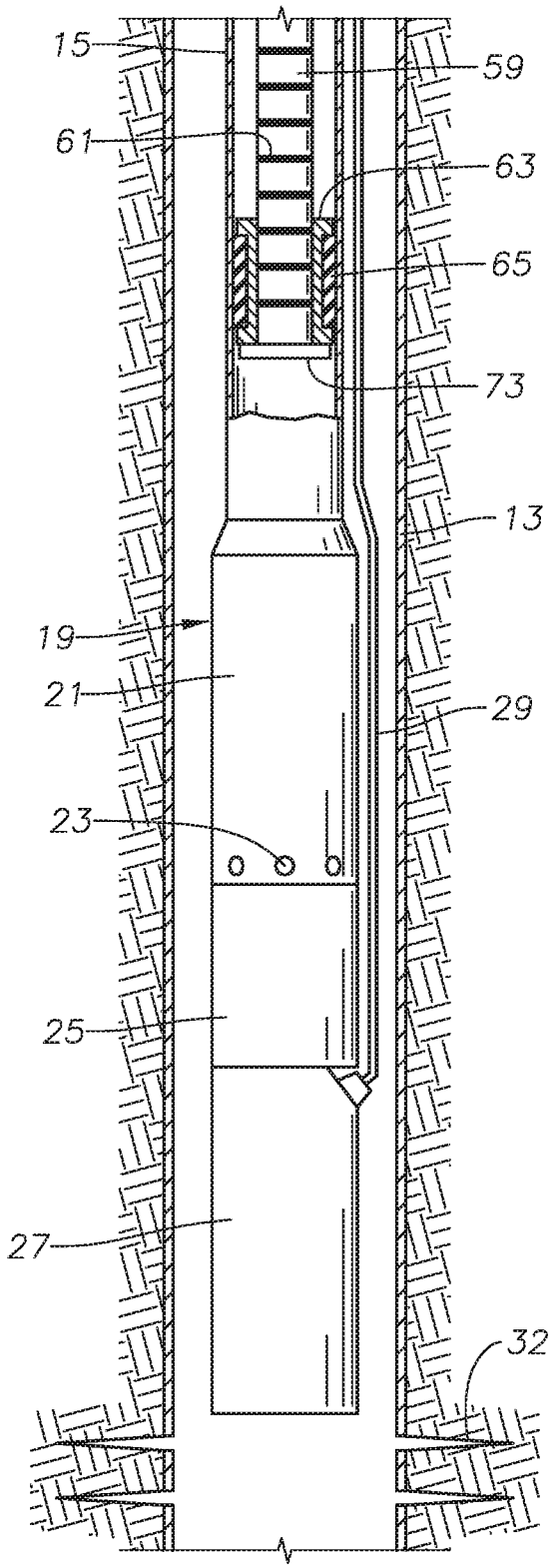

Referring to FIG. 1B, which is a lower continuation of FIG. 1A, a first or lower electrical submersible pump (ESP) 19 is connected to a lower end of production tubing 15 in this embodiment. First ESP 19 may be conventional, having a pump 21 with an intake 23. Pump 21 is typically a rotary pump such as a centrifugal pump having a large number of stages, each stage having a rotating impeller and a nonrotating diffuser. Alternately, pump 21 could be another type such as a progressing cavity type. Pump 21 discharges well fluid into production tubing 15 while operating.

A seal section 25 secures to a lower end of pump 21. An electrical motor 27 secures to a lower end of seal section 25. Motor 27 rotates a drive shaft assembly (not shown) that extends through seal section 25 and into pump 21. Motor 27 contains a dielectric lubricant that is sealed within motor 27 by seal section 25. Seal section 25 may have a movable element, such as an elastomeric bag or metal bellows, that equalizes the pressure of the lubricant in motor 27 with the hydrostatic pressure of the well fluid in casing 13. Alternately, a pressure equalizer could be mounted to a lower end of motor 27.

A power cable 29, which includes a motor lead on its lower end, supplies electrical power, normally three-phase, to motor 27. Power cable 29, referred to herein as an external power cable, extends alongside the exterior of production tubing 15 and sealingly through a power cable opening 31 in wellhead 11, as shown in FIG. 1A.

Perforations 32 (FIG. 1B) or other openings in casing 13 allow the flow of well fluid from an earth formation into casing 13. A flowline 33 (FIG. 1A) connects to wellhead 11 for conveying well fluid pumped by first ESP 19 up production tubing 15. In the event first ESP 19 or external power cable 29 fail, a typical solution in the prior art is to employ a workover unit (not shown) to pull production tubing 15, first ESP 19, and external power cable 29 from casing 13. The operator may replace first ESP 19 with another ESP, then lower the replacement ESP on production tubing 15. However, when prices of crude oil are low, replacing first ESP 19 may not be feasible because of the cost.

In this disclosure, if first ESP 19 and/or external power cable 29 fail, the operator can install a second ESP 35 within production tubing 15 above first ESP 19. Installing second ESP 35 can be done without a workover rig, thus delaying the cost of pulling production tubing 15, first ESP 19, and external power cable 29.

Second ESP 35 may be smaller in diameter than first ESP 19 because second ESP 35 must be lowered into production tubing 15, rather that secured to a lower end. Second ESP 35 has a pump 37 that typically is a rotary type, such as a centrifugal pump or progressing cavity pump. Pump 37 could alternately be a reciprocating pump driven by a downhole linear drive mechanism. Pump 37 has an intake on its lower end and a discharge 39 on its upper end that discharges well fluid into production tubing 15. In this example, a seal section 41 secures to pump discharge 39, and a motor 43 connects to the upper end of seal section 41. Motor 43 is an electrical motor, typically three-phase, that is filled with a dielectric lubricant. Seal section 41 may have a pressure equalizer portion, such as a flexible bag or bellows, to equalize the pressure of the lubricant with the well fluid in production tubing 15. Alternately, a pressure equalizer could be mounted on the upper end of motor 43.

An adapter 45 at the upper end of second ESP 35 secures second ESP 35 to a string of coiled tubing 47. Coiled tubing 47 comprises a continuous length of tubing that is deployed from a reel (not shown). Coiled tubing 47 extends upward though production tubing hanger 17 and is supported by a coiled tubing hanger 49 at wellhead 11. A variety of coiled tubing hangers 49 may be used and either landed in production tubing hanger 17 or above. Coiled tubing hanger 49 is configured with flow passages to allow the flow of well fluid flowing up production tubing 15 to flowline 33.

Coiled tubing 47 contains an internal power cable 51 extending through it. Various supporting techniques are known to transfer the weight of internal power cable 51 along its length to coiled tubing 47. Internal power cable 51 may extend out the upper end of coiled tubing 47 sealingly through a power cable opening 53 in wellhead 11. Internal power cable 51 has insulated conductors 55 that connect to a power source.

Second ESP 35 has a downward extending intake tube 57 on its lower end. A seal stack member 59 secures to the lower end of intake tube 57, or alternately, may be a part of intake tube 57. Seal stack member 59 is a tubular member having at least one annular seal ring 61, and preferably several. In the example shown in FIG. 1B, seal rings 61 are axially separated from each other along a length of seal stack member 59.

Seal stack member 59 carries a packer 63 during run-in and retrieval. In this embodiment, packer 63 has a metal body with an elastomeric sleeve 65 extending around it. Sleeve 65 is formed of a known rubber type of material that will swell when immersed in well fluid containing hydrocarbons. Sleeve 65 initially has a smaller outer diameter than the inner diameter of production tubing 15. At the setting depth, which is a selected distance above first ESP 19, packer 63 will be immersed in well fluid. After a time period while at the setting depth, sleeve 65 will swell sufficiently to form a sealing engagement with the inner side wall of production tubing 15. The sealing engagement will provide enough friction to support the weight of packer 63.

Figure 2:
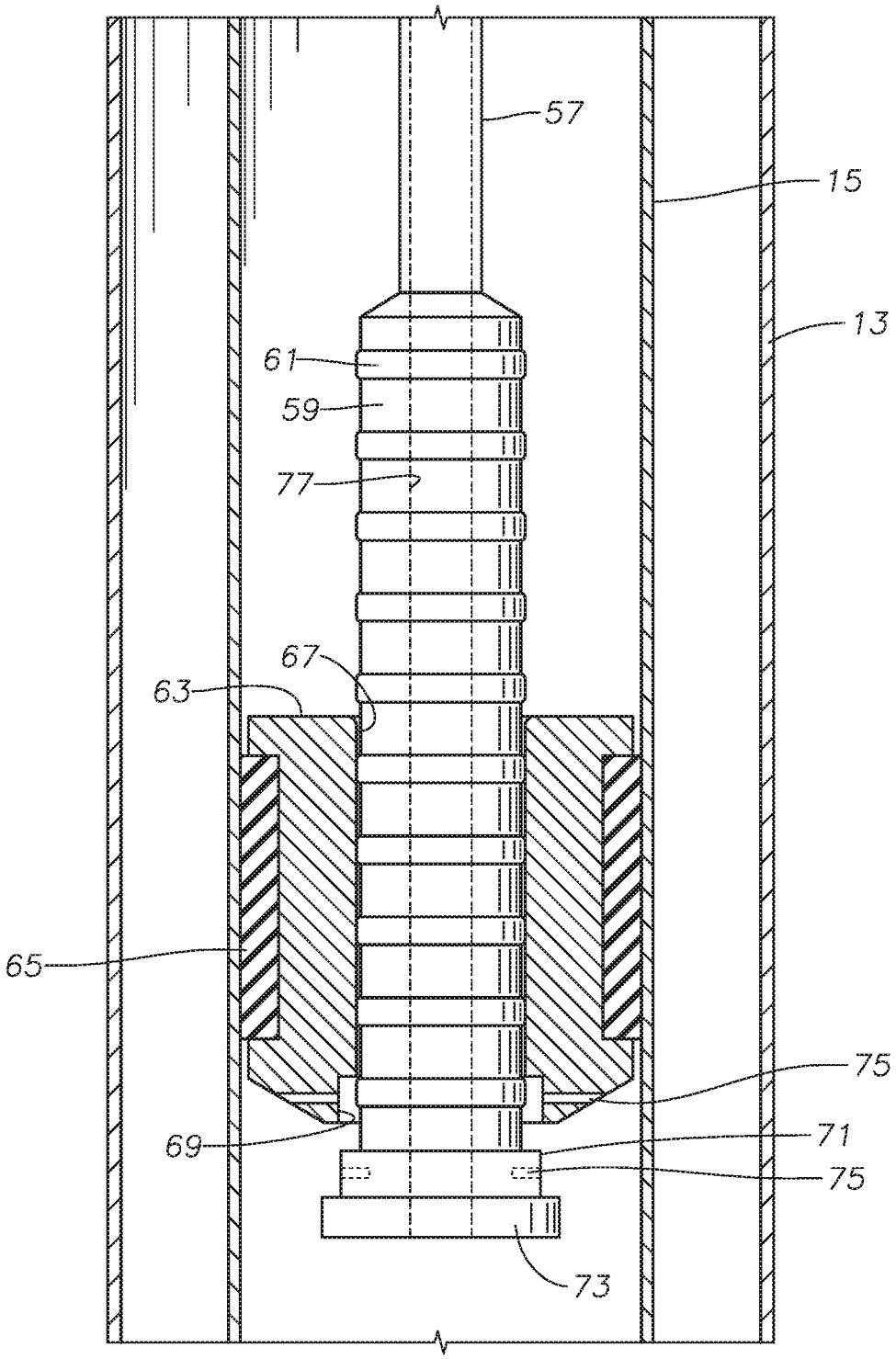
FIG. 2 is an enlarged side view, partially sectioned, of the seal stack and packer of FIGS. 1A and 1B.

Referring to FIG. 2, the body of packer 63 has an axially extending polished bore 67 extending through it. Seal stack member 59 extends through bore 67, and at least some of the annular seal rings 61 will seal against the side wall of bore 67. The axial length from the top of the uppermost seal member seal ring 61 to the lower end of the lowermost seal member seal ring 61 is greater than the axial length of bore 67.

In this example, packer bore 67 has a counterbore 69 at its lower end. Seal stack member 59 has an upper flange 71 that nests within counterbore 69 during run-in and retrieval. As explained below and illustrated in FIG. 2, upper flange 71 may be a short distance below counterbore 69 after packer 63 sets. Seal stack member 59 has a lower flange 73 below upper flange 71. Lower flange 73 has a larger outer diameter than upper flange 71 and counterbore 69. During run-in and retrieval, the upper side of lower flange 73 abuts the lower end of packer 63 to carry packer 63 with seal stack member 59. FIG. 1B shows lower flange 73 abutting the lower end of packer 63.

A retainer may be employed to initially hold packer 63 in the lower position with lower flange 73 abutting the lower end of packer 63. In this embodiment, the retainer comprises a plurality of shear members 75, such as shear pins or shear screws that extend radially from holes in the body of packer 63 into mating holes in upper flange 71. Shear members 75 are designed to shear and allow seal member flanges 71, 73 to move downward relative to packer 63 if a downward force on seal stack member 59 is sufficient. Seal stack member 59 has an axial passage 77 extending therethrough that registers with a passage in intake tube 57.

To install second ESP 35, the operator attaches second ESP 35 to coiled tubing 47 and lowers the assembly into the production tubing 15. Shear members 75 will retain upper flange 71 in counterbore 69 and lower flange 73 in abutment with the lower end of packer 63. At least one of the seal member seal rings 61 will be located above packer bore 67 in this example. Other of the seal rings 61 will be in sealing engagement with packer bore 67. When at the desired setting depth, technicians will install coiled tubing hanger 49 in wellhead 11 and lead internal power cable 51 through opening 53 to a power source. At the desired setting depth, packer 63 will be immersed in well fluid from perforations 32. If a no longer operable, first ESP 19 remains attached to production tubing 15, and the well fluid will migrate up casing 13 through pump 21 of first ESP 19. The well fluid will cause sleeve 65 to swell and form a sealing engagement with the inner side wall of production tubing 15.

The operator supplies power to second ESP motor 43, which causes second ESP pump 37 to operate. Well fluid flows from perforations 32 through first ESP pump 21 and up passage 77 of seal stack member 59. The well fluid flows up intake tube 57 into the lower end of second ESP pump 37, which discharges the well fluid at higher pressure into an annulus in production tubing 15 surrounding second ESP seal section 41, motor 43, and coiled tubing 47. The well fluid flows into wellhead 11 and out flow line 33.

If the well temperature is sufficiently high to cause significant thermal growth or lengthening of coiled tubing 47 relative to production tubing 15, a downward force will be exerted on seal stack member 59 that is initially resisted by packer 63 because of the gripping of packer sleeve 65 with casing 13. If the force is sufficiently high, shear members 75 part, allowing flanges 71, 73 to move downward relative to packer 63 as illustrated in FIG. 2. Seal stack member 59 continues to seal with packer 63 because some of the annular seal rings 61 will still engage packer bore 67. At least one of the seal rings 61 may move below packer bore 67 due to the thermal growth. If the well cools sufficiently, which may occur while second ESP 35 is shut down, the length of coiled tubing 47 may shrink, causing seal stack member flanges 71, 73 to move back upward toward packer 63.

Alternatively, second ESP 35 may also be installed in production tubing 15 that does not have first ESP 19 on the lower end. The installation would be the same as described.

For retrieval of second ESP 35, flanges 73, 75 could alternately be configured to release from seal stack member 59 in the event of an upward pull. In that case, packer 63 would remain set in production tubing 15. A replacement second ESP 35 could be lowered into production tubing 15 and its seal stack member 59 stabbed into bore 67 of packer 63.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. An assembly for pumping well fluid from a well, comprising:

a string of coiled tubing for lowering into a conduit of the well;

an electrical submersible pump ("ESP") secured to the string of coiled tubing, the ESP having a longitudinal axis, a pump and a motor;

a seal member having at least one annular seal and connected into the ESP concentric with the axis of the ESP;

a packer carried by the ESP and configured to set in the conduit at a selected depth, the packer having a body with a bore through which the seal member extends with the seal in sealing engagement with the bore;

shear means for initially retaining the body of the packer in a fixed axial position with the seal member as the ESP is lowered on the string of coiled tubing into the conduit and while the packer is being set, and after the packer has set, for enabling the seal member to move downward in the bore of the body of the packer in response to a downward axial force on the seal member due to thermal growth of the string of coiled tubing relative to conduit, the shear means comprising a shear pin extending laterally from the body of the packer into the seal member;

wherein:

the seal member comprises a tubular member having a central passage for receiving the flow of well fluid while the pump is operating;

the at least one annular seal comprises a plurality of annular seal rings mounted around the tubular member and axially spaced apart from each other; and the seal rings extend over an axial length on the tubular member that is greater than an axial length of the bore of the packer.

2. An assembly for pumping well fluid from a well, comprising:

a string of coiled tubing for lowering into a conduit of the well;

an electrical submersible pump ("ESP") secured to the string of coiled tubing, the ESP having a longitudinal axis, a pump and a motor;

a seal member having at least one annular seal and connected into the ESP concentric with the axis of the ESP;

a packer carried by the ESP and configured to set in the conduit at a selected depth, the packer having a body with a bore through which the seal member extends with the seal in sealing engagement with the bore;

shear means for initially retaining the body of the packer in a fixed axial position with the seal member as the ESP is lowered on the string of coiled tubing into the conduit and while the packer is being set, and after the packer has set, for enabling the seal member to move downward in the bore of the body of the packer in response to a downward axial force on the seal member due to thermal growth of the string of coiled tubing relative to conduit, the shear means comprising a shear pin extending laterally from the body of the packer into the seal member;

wherein:

the seal member comprises a tubular member having a central passage for receiving the flow of well fluid while the pump is operating;

the at least one annular seal comprises a plurality of seal rings extending around the tubular member and spaced axially apart from each other; and prior to the shear pin being sheared, at least one of the seal rings will be located above the bore of the packer.

3. An assembly for pumping well fluid from a well, comprising:

a string of coiled tubing for lowering into a conduit of the well;

an electrical submersible pump ("ESP") secured to the string of coiled tubing, the ESP having a longitudinal axis, a pump and a motor;

a seal member having at least one annular seal and connected into the ESP concentric with the axis of the ESP;

a packer carried by the ESP and configured to set in the conduit at a selected depth, the packer having a body with a bore through which the seal member extends with the seal in sealing engagement with the bore;

shear means for initially retaining the body of the packer in a fixed axial position with the seal member as the ESP is lowered on the string of coiled tubing into the conduit and while the packer is being set, and after the packer has set, for enabling the seal member to move downward in the bore of the body of the packer in response to a downward axial force on the seal member due to thermal growth of the string of coiled tubing relative to conduit, the shear means comprising a shear pin extending laterally from the body of the packer into the seal member;

wherein the seal member comprises:

an axially extending tubular intake member at a lower end of the ESP and extending downward from the pump; wherein the at least one annular seal comprises a plurality of seal rings extending around the tubular intake member and spaced axially apart from each other;

prior to the shear pin shearing, at least one of the seal rings will be located above the bore of the packer; and after the shear pin has sheared, at least one of the seal rings will be located below the bore of the packer.

4. An assembly for pumping well fluid from a well, comprising:

an electrical submersible pump ("ESP") having a longitudinal axis, a pump and a motor;

a string of coiled tubing secured to and extending upward from the ESP, the string of coiled tubing having an upper end portion for mounting to a wellhead;

a tubular intake member extending downward from the pump, the intake member having a passage therethrough for flowing well fluid to the pump;

a packer having a body with a bore therethrough, the intake member extending downward into the bore, the packer being configured to be lowered into a conduit along with the ESP and set in the conduit in the well at a selected depth;

a recess in the body of the packer at a lower end of the bore having an inward facing cylindrical wall of larger diameter than the bore;

a flange on the intake member, the flange having an outward facing cylindrical wall closely received by the inward facing cylindrical wall while the ESP and the packer are being lowered into the conduit;

upper and lower seal rings on the intake member that seal the intake member to the bore of the packer, the lower seal ring having an outer diameter that is less than the diameter of the inward facing cylindrical wall, the lower seal ring being in sealing engagement with the bore above the recess while the ESP and the packer are being lowered into the conduit;

an outer shear pin hole in the body of the packer extending laterally inward from an exterior of the packer to the inward facing cylindrical wall;

an inner shear pin hole in the flange extending laterally inward from the outward facing cylindrical wall of the flange, the outer shear pin hole and the inner shear pin hole being aligned with each other while the flange is positioned in the recess for lowering the ESP and the packer into the conduit;

a shear pin having an outer portion within the outer shear pin hole and an inner portion within the inner shear pin hole to initially retain the body of the packer in a fixed axial position with the intake member as the ESP and the packer are lowered on the string of coiled tubing into the conduit and after setting of the packer; wherein the inner portion of the shear pin is configured to shear from the outer portion of the shear pin after the packer has been set in response to a downward axial force on the intake member due to thermal growth of the string of coiled tubing relative to the conduit, enabling the intake member to move downward in the bore of the packer to accommodate the thermal growth;

the lower seal ring is positioned to move downward past a sheared off inner end of the outer portion of the shear pin as the intake member moves downward in the body to accommodate the thermal growth;

the lower seal ring has an outer diameter that is less than the diameter of the inward facing cylindrical wall so as to avoid contact with the sheared off inner end of the outer portion of the shear pin;

the flange has a greater outer diameter than a minimum inner diameter of the bore of the packer, preventing the ESP from being retrieved from the packer after the shear pin has sheared;

prior to shearing of the shear pin, the upper seal ring is located above the bore; and after shearing of the shear pin and the lower seal ring is below the bore, the upper seal ring in sealing engagement with the bore.

5. An assembly for pumping well fluid from a well, comprising:

an electrical submersible pump ("ESP") having a longitudinal axis, a pump and a motor;

a string of coiled tubing secured to and extending upward from the ESP, the string of coiled tubing having an upper end portion for mounting to a wellhead;

a tubular intake member extending downward from the pump, the intake member having a passage therethrough for flowing well fluid to the pump;

a packer having a body with a bore therethrough, the intake member extending downward into the bore, the packer being configured to be lowered into a conduit along with the ESP and set in the conduit in the well at a selected depth;

a recess in the body of the packer at a lower end of the bore having an inward facing cylindrical wall of larger diameter than the bore;

a flange on the intake member, the flange having an outward facing cylindrical wall closely received by the inward facing cylindrical wall while the ESP and the packer are being lowered into the conduit;

upper and lower seal rings on the intake member that seal the intake member to the bore of the packer, the lower seal ring having an outer diameter that is less than the diameter of the inward facing cylindrical wall, the lower seal ring being in sealing engagement with the bore above the recess while the ESP and the packer are being lowered into the conduit;

an outer shear pin hole in the body of the packer extending laterally inward from an exterior of the packer to the inward facing cylindrical wall;

an inner shear pin hole in the flange extending laterally inward from the outward facing cylindrical wall of the flange, the outer shear pin hole and the inner shear pin hole being aligned with each other while the flange is positioned in the recess for lowering the ESP and the packer into the conduit;

a shear pin having an outer portion within the outer shear pin hole and an inner portion within the inner shear pin hole to initially retain the body of the packer in a fixed axial position with the intake member as the ESP and the packer are lowered on the string of coiled tubing into the conduit and after setting of the packer; wherein the inner portion of the shear pin is configured to shear from the outer portion of the shear pin after the packer has been set in response to a downward axial force on the intake member due to thermal growth of the string of coiled tubing relative to the conduit, enabling the intake member to move downward in the bore of the packer to accommodate the thermal growth;

the lower seal ring is positioned to move downward past a sheared off inner end of the outer portion of the shear pin as the intake member moves downward in the body to accommodate the thermal growth; the lower seal ring has an outer diameter that is less than the diameter of the inward facing cylindrical wall so as to avoid contact with the sheared off inner end of the outer portion of the shear pin;

the flange has a greater outer diameter than a minimum inner diameter of the bore of the packer, preventing the ESP from retrieved from the packer after the shear pin has sheared; and the seal rings extend over an axial length on the intake member that is greater than an axial length of the bore of the packer.

* * * * *